US010013922B2

(12) United States Patent
Seki

(10) Patent No.: US 10,013,922 B2
(45) Date of Patent: Jul. 3, 2018

(54) CONTROL DEVICE AND CONTROL DEVICE CONTROLLING METHOD

(71) Applicant: Sharp Kabushiki Kaisha, Osaka-shi, Osaka (JP)

(72) Inventor: Fumitaka Seki, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 6 days.

(21) Appl. No.: 14/914,725

(22) PCT Filed: Aug. 26, 2014

(86) PCT No.: PCT/JP2014/072306
§ 371 (c)(1),
(2) Date: Feb. 26, 2016

(87) PCT Pub. No.: WO2015/041012
PCT Pub. Date: Mar. 26, 2015

(65) Prior Publication Data
US 2016/0210908 A1 Jul. 21, 2016

(30) Foreign Application Priority Data
Sep. 20, 2013 (JP) ..... 2013-196036

(51) Int. Cl.
*G09G 3/34* (2006.01)
*G09G 3/36* (2006.01)
*G09G 5/06* (2006.01)

(52) U.S. Cl.
CPC ..... *G09G 3/3406* (2013.01); *G09G 3/3614* (2013.01); *G09G 3/3618* (2013.01); (Continued)

(58) Field of Classification Search
None
See application file for complete search history.

(56) References Cited

U.S. PATENT DOCUMENTS

2007/0126757 A1* 6/2007 Itoh ..... G09G 3/3233 345/690
2008/0079756 A1 4/2008 Akai et al.
(Continued)

FOREIGN PATENT DOCUMENTS

JP 2008-083604 A 4/2008
JP 2009-271349 A 11/2009
WO 2013/021846 A1 2/2013

OTHER PUBLICATIONS

Official Communication issued in International Patent Application No. PCT/JP2014/072306, dated Dec. 2, 2014.

*Primary Examiner* — Matthew Yeung
(74) *Attorney, Agent, or Firm* — Keating & Bennett, LLP

(57) ABSTRACT

Included are: an image analyzing section (32) which determines whether an image is a still image or a moving image; an image processing section (33) which, in a case where the image analyzing section (32) determines that the image is the moving image, increases pixel values of respective pixels of a display screen from those before the image analyzing section (32) determines that the image is the moving image; and a BL control section (34) which lowers brightness of a backlight (41) from that before the image analyzing section (32) determines that the image is the moving image.

6 Claims, 5 Drawing Sheets

(52) U.S. Cl.
CPC ..... *G09G 3/3696* (2013.01); *G09G 5/06* (2013.01); *G09G 2300/0478* (2013.01); *G09G 2320/0233* (2013.01); *G09G 2320/0247* (2013.01); *G09G 2320/0261* (2013.01); *G09G 2320/062* (2013.01); *G09G 2320/0613* (2013.01); *G09G 2320/0646* (2013.01); *G09G 2320/103* (2013.01); *G09G 2330/022* (2013.01); *G09G 2340/0435* (2013.01)

(56) References Cited

U.S. PATENT DOCUMENTS

| | | | | |
|---|---|---|---|---|
| 2009/0303170 | A1* | 12/2009 | Chung | G09G 3/3426 345/102 |
| 2010/0134527 | A1 | 6/2010 | Inada et al. | |
| 2010/0302133 | A1* | 12/2010 | Liang | G09G 3/3426 345/102 |
| 2012/0146968 | A1* | 6/2012 | Glen | G09G 5/003 345/204 |

* cited by examiner

CONTROL DEVICE AND CONTROL DEVICE CONTROLLING METHOD

TECHNICAL FIELD

The present invention relates to a control device, a dynamic backlight control program, and a method of controlling a control device.

BACKGROUND ART

In recent years, development of a liquid crystal display panel in which TFTs (Thin Film Transistors) are each made up of an oxide semiconductor that employs indium (In), gallium (Ga), and zinc (Zn) (hereinafter, abbreviated as an oxide semiconductor liquid crystal panel) has been attempted. In a case where the oxide semiconductor liquid crystal panel is employed, it is possible to, due to an ON/OFF characteristic of the TFTs, realize a liquid crystal display panel which has a high charge retention characteristic and which has a longer interval between refreshes (low refresh rate driving). This makes it possible to realize a display device which consumes less electric power (hereinafter, referred to as a "liquid crystal display device").

Meanwhile, as a technique of allowing a reduction in electric power consumed by a liquid crystal display device, a dynamic backlight control (hereinafter, abbreviated as DBC) technique is used in a wide range of fields such as a liquid crystal television or a mobile terminal. One example of the DBC technique is a liquid crystal driver of Patent Literature 1. The liquid crystal driver is configured such that a still image area and a moving image area are different from each other in expansion rate of a pixel value so that merely the moving image region has high display brightness. This allows both (i) a reduction in electric power consumption and (ii) an improvement in visibility.

CITATION LIST

Patent Literature

[Patent Literature 1]
Japanese Patent Application Publication Tokukai No. 2008-83604 (Publication date: Apr. 10, 2008)

SUMMARY OF INVENTION

Technical Problem

However, although each of the oxide semiconductor liquid crystal panel and the DBC is a technique (or a device) for reducing electric power consumption, the oxide semiconductor liquid crystal panel and the DBC have the following problem. That is, in a case where (i) the oxide semiconductor liquid crystal panel and the DBC are simply combined with each other and (ii) operation of one of the oxide semiconductor liquid crystal panel and the DBC is improved, the one of the oxide semiconductor liquid crystal panel and the DBC adversely affects operation of the other one. This causes each effect of such techniques to be lowered. For example, according to a display device employing the oxide semiconductor liquid crystal panel, electric power consumption is reduced by realizing low refresh driving and by not generating an unnecessary frame image.

On the other hand, according to the DBC, it is necessary to carry out the DBC in stages over a plurality of frame images in order to reduce a flicker in a display which flicker is caused by rapid image processing and rapid backlight control (hereinafter, merely referred to as "BL control"). Therefore, the number of the plurality of frame images with use of which the DBC is carried out is preferably as large as possible.

As described above, in a case where the oxide semiconductor liquid crystal panel and the DBC are simply combined with each other, unnecessarily-extra frame images are generated and accordingly, an effect of reducing electric power consumed by the oxide semiconductor liquid crystal panel is lowered.

The present invention has been made in view of the above problems, and an object of the present invention is to provide a control device and the like, each of which is capable of suppressing a deterioration in effect of reducing electric power consumption which deterioration is caused in a case where DBC processing is enabled with respect to a display device capable of being driven at a low refresh rate, such as a display device employing a liquid crystal panel in which an oxide semiconductor is used for each semiconductor layer of TFTs.

Solution to Problem

In order to attain the above object, a control device in accordance with an aspect of the present invention is a control device which controls a display device capable of being driven at a low refresh rate, including; an image analyzing section which determines whether a first image, to which a second image displayed by a display screen is updated in response to a request to update the second image, is a still image or a moving image; an image processing section which, in a case where the image analyzing section determines that the first image is the moving image, increases pixel values of respective pixels of the display screen which is to display the first image, from those before the image analyzing section determines that the first image is the moving image; and a backlight control section which lowers, in accordance with an increase in pixel values of the respective pixels, brightness of a backlight from that before the image analyzing section determines that the first image is the moving image.

In order to attain the above object, a method of controlling a control device in accordance with as aspect of the present invention is a method of controlling a control device which controls a display device capable of being driven at a low refresh rate; the method including the steps of: (a) determining whether a first image, to which a second image displayed by a display screen is updated in response to a request to update the second image, is a still image or a moving image; (b) increasing, in a case where it is determined that the first image is the moving image, pixel values of respective pixels of the display screen which is to display the first image, from those before it is determined that the first image is the moving image; and (c) lowering, in accordance with an increase in pixel values of the respective pixels of the display screen which is to display the first image, brightness of a backlight from that before it is determined that the first image is the moving image.

Advantageous Effects of Invention

According to an aspect of the present invention, it is possible to suppress a deterioration in effect of reducing electric power consumption which deterioration is caused in a case where DBC processing is enabled with respect to a display device capable of being driven at a low refresh rate.

For a fuller understanding of the nature and advantages of the invention, reference should be made to the ensuing detailed description taken in conjunction with the accompanying drawings.

DESCRIPTION OF EMBODIMENTS

The following descriptions will discuss embodiments of the present invention with reference to FIGS. 1 through 5. Descriptions of configurations other than those to be described in a specific embodiment below may be omitted as necessary. Note, however, that, in a case where the configurations other than those to be described in the specific embodiment are described in another embodiment, the configurations other than those to be described in the specific embodiment have functions described in the another embodiment. Note also that, in each embodiment, identical reference signs will be given, for convenience, to respective members having functions identical to those of members described in a different embodiment, and descriptions of the members will be omitted as necessary. Note also that, as a display device, the following descriptions take, as an example, a liquid crystal display device employing a liquid crystal panel in which an oxide semiconductor is used for each semiconductor layer of TFTs. However, the display device is not limited to such a liquid crystal display device. The present invention can be applied to any display device, provided that the any display device is capable of being driven at a low refresh rate.

[Liquid Crystal Display Device 1]

Figure 1:
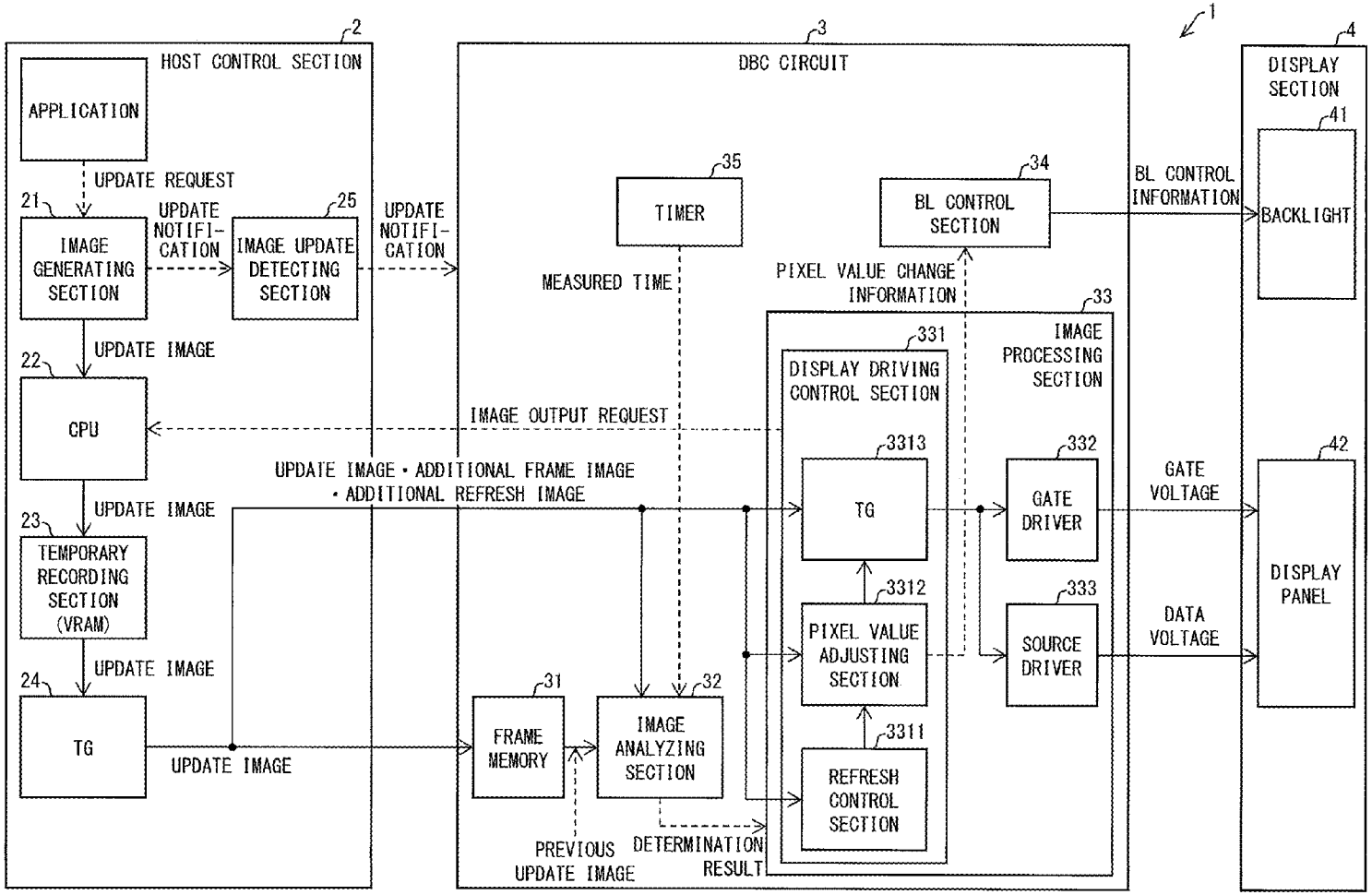
FIG. 1 is a block diagram illustrating a configuration of a liquid crystal display device in accordance with an embodiment of the present invention.

FIG. 1 is a block diagram illustrating a configuration of a liquid crystal display device 1 in accordance with the present embodiment. As illustrated in FIG. 1, the liquid crystal display device 1 includes a host control section 2, a DBC circuit (control device) 3, and a display section (display device) 4.

Note here that DBC is an abbreviation of Dynamic Backlight Control and is carried out such that (i) pixel values (or gradation values) of respective pixels constituting a display screen which is to display an image, are raised (for example, an expansion rate of the pixel values is increased) and (ii) brightness of a backlight (hereinafter, merely referred to as a "BL") is accordingly lowered (for example, a lowering rate of the brightness is increased). The DBC allows a reduction in electric power consumed by the liquid crystal display device 1 without making a significant difference to appearance of an image to be displayed by the display screen.

(Configuration of Host Control Section)

The host control section 2 (i) generates image data of a frame image (hereinafter, merely referred to as an "update image"), corresponding to one screen (one frame), to which a displayed image is to be updated in response to an update request from an application or an update request from the outside, (ii) temporarily stores therein the image data thus generated, and (ii) transfers, as necessary, the image data to the DBC circuit 3. Therefore, the host control section 2 includes an image generating section 21, a CPU 22, a temporary recording section (recording section) 23, a TG 24 (timing generator), and an image update detecting section 25. The host control section 2 is realized by, for example, a control circuit provided on a substrate.

The image generating section 21 generates image data of an update image in response to an update request from the outside. For example, in a case where (1) an application which has been activated and is being run in the liquid crystal display device 1 requests (notifies) the image generating section 21 to update a displayed image, (2) a user of the liquid crystal display device 1 requests, by operating an input section, the image generating section 21 to update a displayed image, and (3) update of a displayed image based on data streaming via the Internet, a broadcast wave, or the like is notified to the image generating section 21, the image generating section 21 generates image data of an update image. In a case where the image generating section 21 has generated the image data of the update image, the image generating section 21 notifies the image update detecting section 25 that the image generating section 21 has generated the image data of the update image (update notification) . Note that how the image update detecting section 25 detects update of a displayed image is not limited to such. For example, the image update detecting section 25 can be configured to directly detect an update request from the above-described application, or the like.

The CPU 22 obtains, from the image generating section 21, image data of a frame image (update image), corresponding to one screen, to which a displayed image is to be updated, and stores the image data in the temporary recording section 23. In accordance with control carried out by the CPU 22, the TG 24 obtains the image data of the update image from the temporary recording section 23, and transfers the image data to the DBC circuit 3. Further, in accordance with control carried out by the CPU 22, the TG 24 transfers, to DBC circuit 3, image data of at least one additional frame image which image data is identical to that of the update image and which image data is to be used for the DBC (later described). Moreover, in accordance with control carried out by the CPU 22, the TG 24 transfers, to the DBC circuit 3, image data of an additional refresh image, being a frame image, in which image data polarities of voltages to be applied to respective electrodes of pixels of a display panel 42 (display screen) (later described) that displays the update image are inversed. The image data of the additional refresh image is to be used for refresh. Transfer of each kind of the image data is carried out in accordance with a data communication specification, such as MIPI (Mobile Industry Processor Interface), of a mobile device. Note that the TG 24 transfers, to the DBC circuit 3, a sync signal together with the each kind of the image data.

The image update detecting section 25 determines whether an image displayed on the display screen of the display section 4 is updated, upon receipt of an update notification from the image generating section 21. The image update detecting section 25 notifies the CPU 22 and the DBC circuit 3 that the image displayed on the display screen is updated. The image generating section 21 supplies image data of an update image to the CPU 22.

(Configuration of DBC Circuit)

The DBC circuit 3 is a control device which drives the display section 4 so as to display image data transferred from the host control section 2 and which controls brightness of a backlight 41. The DBC circuit 3 drives the display section 4 so as to, when displaying a moving image, carry out refresh display at a refresh rate, such as 24 Hz, 30 Hz, or 60 Hz, predetermined with respect the display section 4. Further, depending on whether or not image data of an update image is inputted, the DBC circuit 3 (i) sets a refresh rate (driving cycle), (ii) generates a driving timing in accordance with the refresh rate thus set, and (iii) drives the display section 4 in accordance with the driving timing thus generated. Further, depending on whether or not the DBC circuit 3 is carrying out the DBC, the DBC circuit 3 determines whether or not to output an additional frame image for use in the DBC or determines whether or not to carry out low refresh driving. In addition, depending on whether an image is a still image or a moving image or depending on whether distribution of pixel values (gradation values) of the respective pixels of the display screen which displays an update image significantly varies from the distribution of the pixel values of the respective pixels of the display screen which displays an image coming prior to the update image, the DBC circuit 3 (i) determines whether or not to output an additional frame image for use in the DBC, (ii) determines whether or not to carry out the DBC, or (iii) determines whether or not to carry out the DBC in addition to the low refresh driving.

Figure 2:
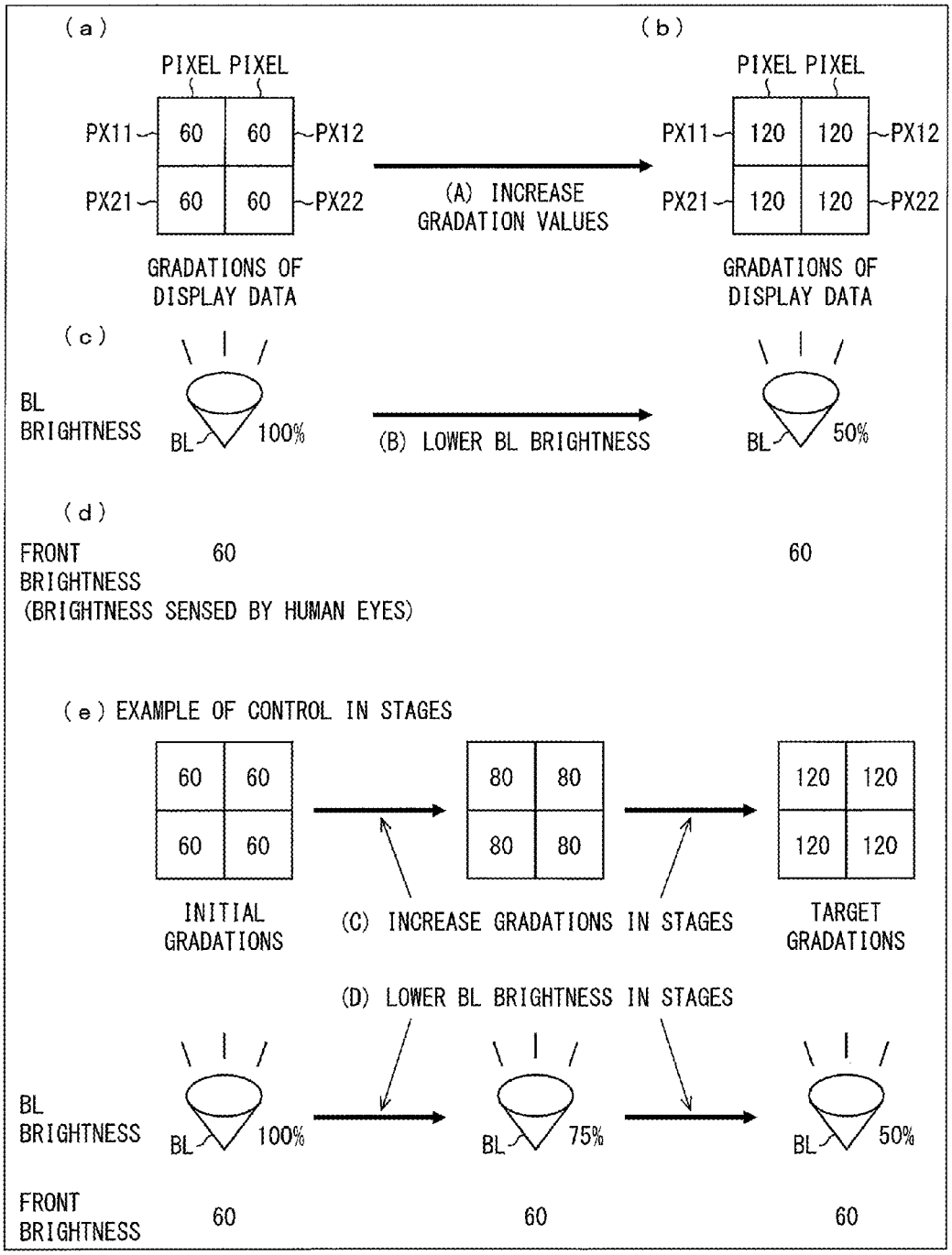
FIG. 2 is a view for explaining operation (DBC) of the liquid crystal display device. (a) and (b) of FIG. 2 each illustrate a state where gradation values of respective pixels are increased. (c) of FIG. 2 illustrates a state where brightness of a backlight is lowered. (d) of FIG. 2 illustrates states of front brightness before/after the gradation values are increased and the brightness is lowered. (e) of FIG. 2 illustrates an example of how the DBC is carried out in stages.

Here, an outline of the DBC will be described with reference to FIG. 2. FIG. 2 is a view for explaining operation (DBC) of the liquid crystal display device 1. For example, (a) of FIG. 2 illustrates gradations of image data which gradations have not been changed (the DBC has not been carried out). (b) of FIG. 2 illustrates the gradations of the image data which gradations have been changed. To be exact, each of pixels is made up of three picture elements R (Red), G (Green), and B (Blue), and gradation values are set for the respective picture elements. However, in the following description, in order to avoid complication, it is assumed that a "pixel" illustrated in (a) of FIG. 2 indicates any one of the picture elements R, G, and B. Further, it is assumed that, in the image data whose gradations have not been changed, a pixel in a target region has a gradation value of 60. A pixel value adjusting section 3312 (later described) changes the gradation value to 120 at a two-fold changing magnification (two-fold expanding magnification) (A) (see (b) of FIG. 2). Note here that, for easiness of understanding, it is assumed that a gradation and transmittance of the pixel are in proportion to each other. In a case where the gradation and the transmittance of the pixel are not in proportion to each other, the gradation and BL brightness are changed so that a product of the transmittance and the BL brightness is not changed (that is, brightness of the pixel is not changed). For example, (c) of FIG. 2 illustrates (i) the BL brightness (indicated as 100% in a case where the BL brightness has the highest value) which has not been lowered (before the DBC is carried out) and (ii) the BL brightness (50%) which has been changed (the DBC is carried out). It is assumed that, before the BL brightness is lowered, the BL brightness has the highest value (100%). In this case, a BL control section 34 (later described) changes the BL brightness to 50% at, for example, a two-fold lowering magnification (two-fold lowering rate) (B).

Note here that such a gradation changing magnification is obtained by dividing (i) a gradation of a pixel in image data which gradation has been changed by (ii) the gradation of the pixel in the image data which gradation has not been changed. Meanwhile, a BL brightness changing magnification is obtained, for example, by dividing (i) a current frequency of a PWM signal by (ii) a maximum frequency of the PWM signal. In the above example, (A) an amount of change in gradation and (B) an amount of change in BL brightness are each set so as not to change front brightness (brightness sensed by human eyes) of each of a plurality of pixels in an image. For example, as illustrated in (d) of FIG. 2, the front brightness "60" is not changed between when the DBC has not been carried out and when the DBC has been carried out.

Next, how the DBC is carried out in stages will be described with reference to (e) of FIG. 2. According to an example illustrated in (e) of FIG. 2, it is assumed that an initial gradation is set to "60" and a target gradation is set to "120." Further, it is assumed that default BL brightness is set to "100% (maximum brightness" and target BL brightness is set to "50%" so as not to change the front brightness of "60."

In a case where, between two frame images, (i) a gradation of a pixel is increased from the initial gradation of "60" to the target gradation of "120" and (ii) BL brightness is lowered from the default BL brightness of "100%" to the target BL brightness of "50%," a flicker is highly likely to occur in an image. Therefore, the DBC is preferably carried out in stages with use of a plurality of frame images. For example, according to the example illustrated in (e) of FIG. 2, gradations of respective pixels are each increased in stages from "60" to "80" and to "120" with use of three frame images (C) and the BL brightness is lowered in stages from "100%" to "75%" and to "50%" (D).

The DBC circuit 3 illustrated in FIG. 1 includes, in order to realize the foregoing driving function, a frame memory 31, an image analyzing section 32, an image processing section 33, a BL control section (backlight control section) 34, and a timer 35.

The image analyzing section 32 of the present embodiment determines, with use of the timer 35, whether or not image data of a frame image (update image) to which a displayed image is to be updated in response to an update request indicates a still image or a moving image. Specifically, the image analyzing section 32 resets the timer 35 at the beginning of an inputted frame image (update image). In a case of a moving image, since frame images are regularly updated, a time measured by the timer 35 does not become longer than a certain time. In a case where the time measured by the timer 35 becomes equal to or longer than the certain time at least once within a given time period (for example, a time period from a start of input of image data of the first one of the given number of update images to an end of input of image data of the final one of the given number of the update images), the image analyzing section 32 determines that the update image is a still image. In a case where the time measure by the timer 35 does not at all become equal to or longer than the certain time within the given time period, the image analyzing section 32 determines that the update image is a moving image.

Note that how to determine whether image data of an update image indicates a still image or a moving image is not limited to such. For example, in a case of a moving image, update images are regularly inputted in a given cycle such as 30 Hz in many cases. Therefore, the image analyzing section 32 can be arranged so as to determine that image data of an update image indicates a moving image in a case where a time from when the timer 35 is reset to when the timer 35 is next reset (or an interval between update of frame images) falls within a predetermined range.

In a case where the image analyzing section 32 determines that an update image is a still image, the image analyzing section 32 (i) obtains (a) a frequency distribution polygon (histogram) in accordance with distribution of the pixel values of the respective pixels constituting the display panel 42 which displays an image coming prior to the update image and (b) a frequency distribution polygon in accordance with the distribution of the pixel values of the respective pixels constituting the display panel 42 which displays the update image, (ii) calculates statistical index values in accordance with those respective frequency distribution polygons, (iii) determines whether an index indicative of a variation between the index values is greater than a threshold set in advance, and (iv) notifies the image processing section 33 of a result of such a determination.

The frame memory 31 causes input of image data to be delayed for one frame by the image data being recorded therein and then read out therefrom. This causes a timing at which the image data (before update) is inputted to be synchronized with a timing at which next image data (after update) is inputted. Therefore, the image analyzing section 32 is capable of comparing (i) a frame image which comes prior to a next frame image with (ii) the next frame image. Note that the liquid crystal display device 1 of the present embodiment employs the frame memory 31 so as to delay image data for one frame, but the present embodiment is not limited such. Any delay circuit can be employed instead of the frame memory 31, provided that the any delay circuit is capable of causing the image data to be delayed for one frame.

The image processing section 33 (i) adjusts a refresh rate at which the display section 4 displays image data, (ii) increases the pixel values to be set to the respective pixels of the display panel 42 which is to display an image, in a case where the DBC is carried out, and (iii) causes, in accordance with image data of a frame image to be displayed, (a) gate voltages to be applied to respective scanning signal lines of the display panel 42 and (b) data voltages to be applied to respective data signal lines of the display panel 4. In order to realize such driving functions, the image processing section 33 includes a display driving control section (signal output control section) 331, a gate driver 332, and a source driver 333. The image processing section 33 further includes a refresh control section 3311, a pixel value adjusting section 3312, and a TG 3313.

The display driving control section 331 is, for example, a so-called COG driver which is provided, by COG (Chip on Glass), on a glass substrate of the display section 4 (the display panel 42). The display driving control section 331 drives the display section 4 so as to display, on the screen, an image based on image data. Further, upon receipt of an update notification from the image update detecting section 25, the display driving control section 331 instructs the CPU 22 of the host control section 2 to (i) read out, from the temporary recording section 23, image data of an update image and (ii) output the image data thus read out. Further, in a case of carrying out the DBC, the display driving control section 331 instructs, as necessary, the CPU 22 of the host control section 2 to, after an update image is outputted, (i) read out, from the temporary recording section 23, at least one additional frame image for use in the DBC which additional frame image is identical to the update image and (ii) output the at least one additional frame image. Moreover, the display driving control section 331 instructs, depending on a refresh rate set by the refresh control section 3311 (later described), the CPU 22 of the host control section 2 to, after an update image is outputted, (i) read out, from the temporary recording section 23, image data corresponding to an additional refresh image in which image data polarities of voltages to be applied to the respective pixels of the display panel 42 that is to display the additional refresh image are inversed as compared with the image data of the update image and (ii) output the image data. More specifically, in order to realize such driving functions, the display driving control section 331 supplies, to the CPU 22 of the host control section 2, a control signal (image output request; request signal, another request signal) for causing the CPU 22 to (i) read out, from the temporary recording section 23, pieces of image data corresponding to the respective update image, additional frame image, and additional refresh image and (ii) output the pieces of the image data.

The display driving control section 331 includes a refresh control section 3311, a pixel value adjusting section 3312, and a TG 3313 (timing generator) in order to realize the foregoing driving functions.

The refresh control section 3311 controls, for example, a timing at which an additional refresh image is outputted, by setting a refresh rate at which the display panel 42 displays an image. Note that the additional refresh image indicates image data which is outputted after an update image is outputted and in which polarities of voltages to be applied to the respective electrodes of the pixels of the display panel 42 which is to display the additional refresh image are inversed. (a) and (b) of FIG. 5 each illustrate an outline of (i) a timing at which image data of an update image is outputted and (ii) a timing at which image data of an additional refresh image is outputted. Here, a case where the image data of the update image is outputted at an output timing illustrated in (a) of FIG. 5 will be described. According to an example illustrated in (b) of FIG. 5, images "A" through "D" are displayed by low refresh driving, and images "E" and "F" are displayed by high refresh driving. According to this example, a time from when an update image "A" is outputted to when an additional refresh image "A" is outputted is 1 (one) second (sec), that is, a refresh rate is set to a low refresh rate of 1 (one) Hz. On the other hand, a time from when an update image "E" is outputted to when an additional refresh image "E" is outputted is 1/60 seconds (sec), that is, the refresh rate is set to a high refresh rate of 60 Hz.

Note that, in a case where a moving image is displayed, the refresh rate is set to, for example, 24 Hz, 30 Hz, or 60 Hz. In a case where a still image is displayed, the refresh rate is set to a low refresh rate (for example, 1 (one) Hz) which is lower than 24 Hz, 30 Hz, or 60 Hz. The refresh control section 3311 notifies the TG 3313 of refresh rate setting information so that the display panel 42 is driven at the refresh rate thus set.

In a case where the DBC is carried out, the pixel value adjusting section 3312 increases the pixel values of the respective pixels of the display panel 42 (display screen) which is to display an image, from those before the above determination. The pixel value adjusting section 3312 notifies the TG 3313 of setting information (pixel value change information) on the pixel values of the respective pixels of the display panel 42 so that the display panel 42 is driven with the pixel values of the respective pixels thus set.

The TG 3313 supplies image data to the source driver 333 in accordance with (i) the refresh rate which is notified from the refresh control section 3311 and (ii) the pixel values of the respective pixels which pixel values are notified from the pixel value adjusting section 3312. Further, the TG 3313 generates a timing signal used to drive the display panel 42 at the refresh rate notified from the refresh control section 3311, and supplies the timing signal to the source driver 333. Note that the TG 3313 can use a sync signal, outputted by the TG 24 of the host control section 2, so as to generate the timing signal.

The source driver 333 stores one line of image data supplied from the TG 3313, at a timing generated by a shift register, and outputs the image data. Further, the source driver 333 selects gradation voltages corresponding to respective gradations indicated by the image data outputted by the shift register, and supplies the gradation voltages, as data voltages, to respective source lines (later described) of the display panel 42.

The gate driver 332 generates gate signals to be outputted to respective gate lines of the display panel 42. The gate driver 332 selects the gate lines line-sequentially by supplying the gate signals to the respective gate lines.

The BL control section 34 lowers, by a given amount, the BL brightness of the backlight 41 from a set value set in advance, in a case where the BL control section 34 receives a pixel value change information from the pixel value adjusting section 3312 when the display driving control section 331 outputs image data of a frame image. In a case where the BL control section 34 does not receive a brightness control information, the BL control section 34 set the BL brightness of the backlight 41 to a set value set in advance (normally, maximum brightness).

The display section 4 includes the display panel 42 and the backlight 41. The display panel 42 is, for example, an oxide semiconductor liquid crystal display panel serving as an active matrix liquid crystal display panel. An oxide semiconductor liquid crystal display panel indicates a liquid crystal display panel in which oxide semiconductor-TFTs are employed for respective switching elements each provided so as to correspond to one or more of a plurality of pixels two-dimensionally arranged. An oxide semiconductor-TFT indicates a TFT in which an oxide semiconductor is employed for a semiconductor layer. Examples of the oxide semiconductor encompass an oxide semiconductor (In—Ga—Zn—O) obtained by using an oxide of indium, gallium, and zinc. According to the oxide semiconductor-TFT, an amount of an electric current flowing in an ON state is large, and an amount of a leak current in an OFF state is small. Therefore, by employing the oxide semiconductor-TFT for a switching element, it is possible to increase a pixel aperture ratio and possible to reduce a refresh rate of image display to approximately 1 (one) Hz. A reduction in refresh rate allows a reduction in electric power consumption. An increase in pixel aperture ratio allows a displayed image to be brighter. Further, in a case where brightness of a displayed image is to be set equal to that of a CG silicon liquid crystal display panel or the like, an increase in pixel aperture ratio causes a decrease in light intensity of the backlight 41, thereby allowing a reduction in electric power consumption. The backlight 41 includes a plurality of LEDs (Light Emitting Diodes), and each of the LEDs emits light by an electric current supplied via the BL control section 34. The display panel 42 is irradiated with backlight emitted from the backlight 41.

Note that the DBC circuit 3 described above can be provided as a dedicated driver LSI. Alternatively, the DBC circuit 3 can be provided, by COG, on an active matrix substrate (glass substrate) (later described) of the display section 4.

[Embodiment 1; operation of liquid crystal display device 1 (Part 1)]

Figure 3:
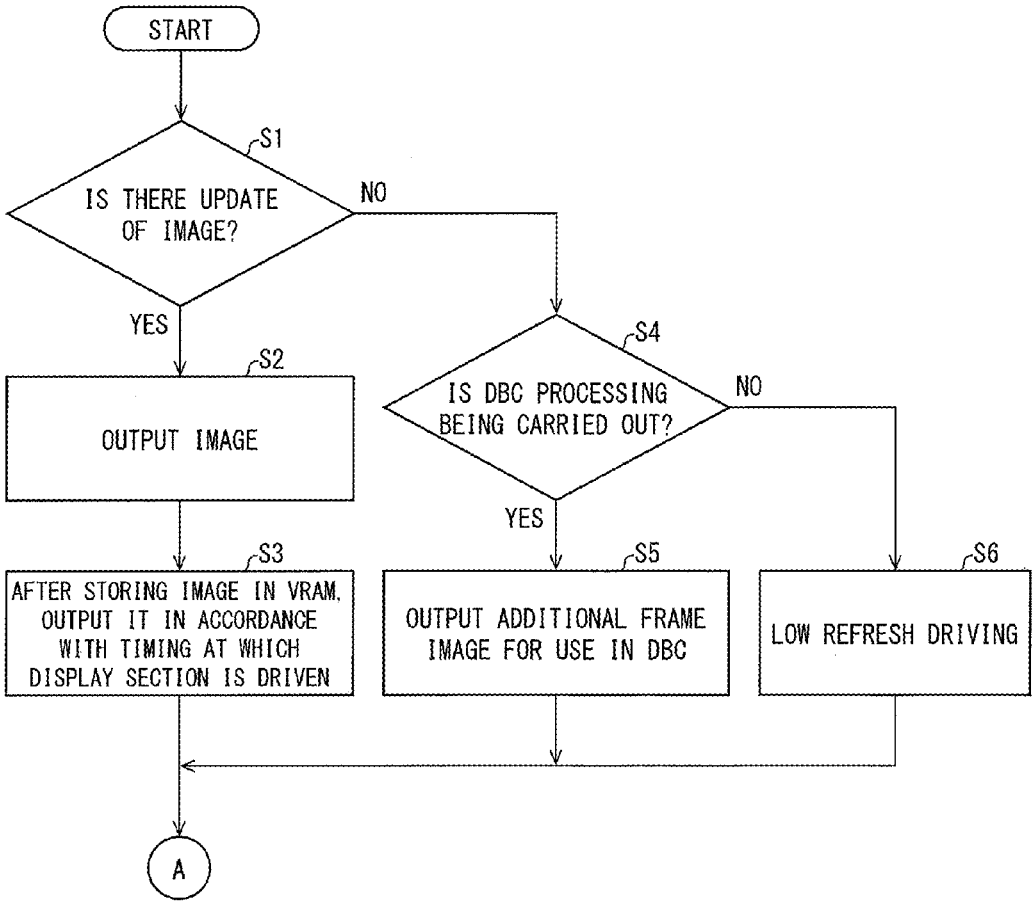
FIG. 3 is a flowchart for explaining the operation of the liquid crystal display device.

Next, an example of operation of the liquid crystal display device 1 in accordance with Embodiment 1 of the present invention will be described below with reference to FIG. 3. FIG. 3 is a flowchart for explaining the operation of the liquid crystal display device 1.

In a step S (hereinafter, the term "step" will be omitted) 1, in a case where there is a new image (update image) desired to be displayed, e.g., in a case where an application which has been activated and is being run in the liquid crystal display device 1 requests (notifies) the image generating section 21 to update a displayed image as in the above-described example, the operation proceeds to S2. In a case where there is no update image, the operation proceeds to S4.

In S2, the image generating section 21 generates image data of the update image, and the operation proceeds to S3. In so doing, the image generating section 21 notifies the image update detecting section 25 that the image generating section 21 has generated the image data of the update image (update notification). In a case where the image update detecting section 25 receives the update notification from the image generating section 21, the image update detecting section 25 determines that there is update of the displayed image, and notifies the DBC circuit 3 and the CPU 22 so (update notification).

In S3, the CPU 22 temporarily stores the image data of the update image, which image data is generated by the image generating section 21, in the temporary recording section 23 (VRAM). Thereafter, in a case where the CPU 22 receives an "image output request (request signal)," which is related to the update image, from the display driving control section 331 of the DBC circuit 3, the CPU 22 controls the TG 24 to output the image data to the DBC circuit 3 in accordance with a timing of liquid crystal driving (the operation proceeds to "A").

In S4, in a case where the display driving control section 331 of the DBC circuit 3 receives no update notification from the image update detecting section 25 of the host control section 2 (there is no update of the displayed image), the display driving control section 331 examines whether or not the DBC processing is being carried out. In a case where the DBC processing is being carried out, the operation proceeds to S5. In a case where the DBC processing is not being carried out, the operation proceeds to S6.

In S6, the display driving control section 331 carries out the low refresh driving (the operation proceeds to "A"). Specifically, the refresh control section 3311 changes a refresh rate to a rate which is set in advance as a low refresh rate. After the TG 24 outputs the image data of the update image, the display driving control section 331 transmits, to the CPU 22, an "image output request (another request signal)" which causes image data of an image, identical to the update image currently stored in the temporary recording section 23, to be outputted. This results in generation of image data of an additional image for use in refresh (hereinafter, referred to an "additional refresh image). In a case where the display driving control section 331 receives the image data of the additional refresh image from the TG 24, the display driving control section 331 controls the TG 3313 to output the additional refresh image (the operation proceeds to "A"). Note that, due to protection of the display panel 42, the display driving control section 331 is configured to control the TG 24 and TG 3313 so as to output, after an elapse of a certain time, the image data of the update image stored in the temporary recording section 23, for example, in a one-second cycle, even in a case where the DBC is not carried out in stages.

[Embodiment 2; operation of liquid crystal display device 1 (Part 2)]

Figure 4:
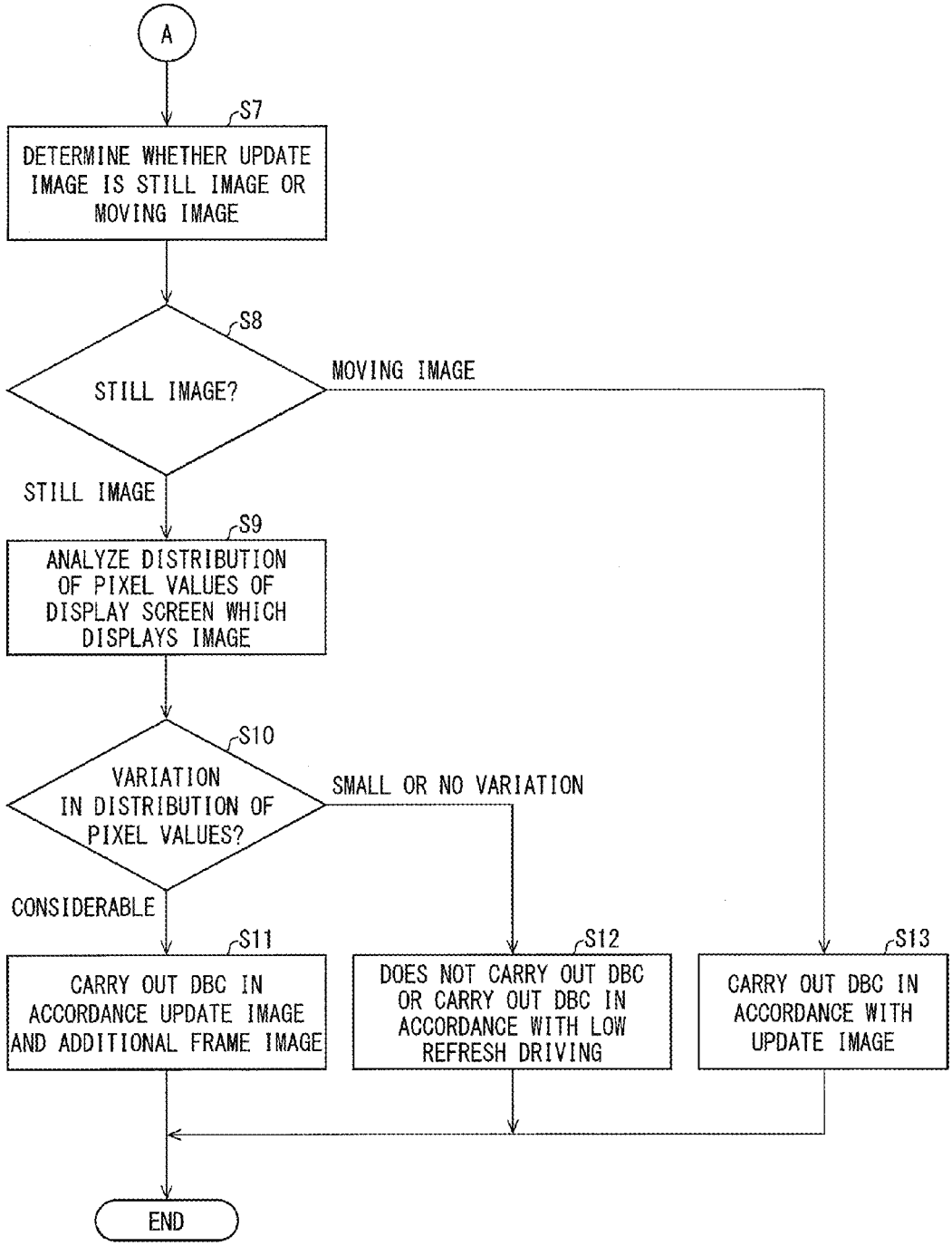
FIG. 4 is a flowchart for explaining the operation of the liquid crystal display device.
Figure 5:
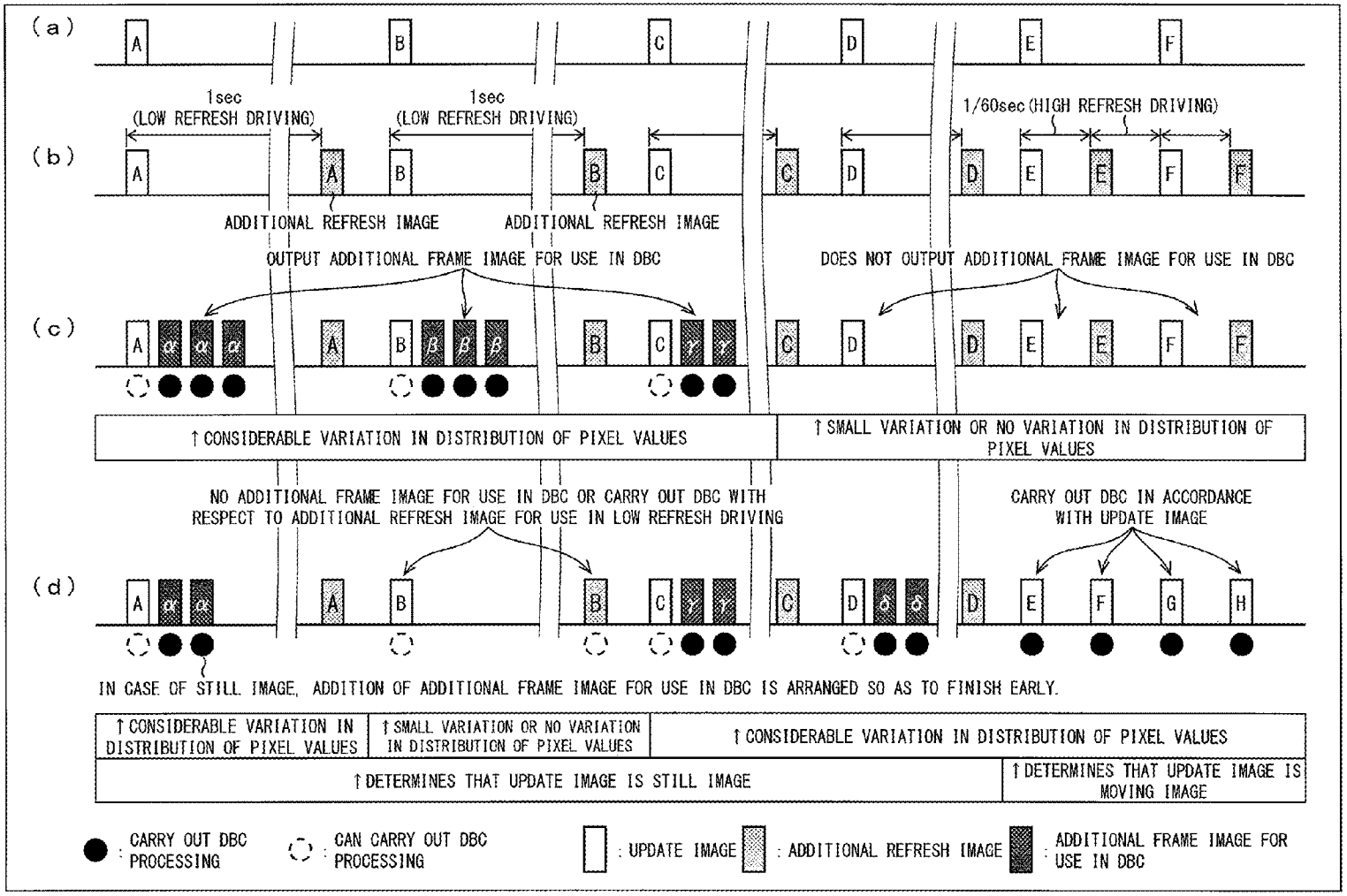
FIG. 5 is a timing chart for explaining the operation of the liquid crystal display device. (a) of FIG. 5 illustrates an example of how an update image is outputted. (b) of FIG. 5 illustrates an example of how an additional refresh image is outputted. (c) of FIG. 5 illustrates (i) an example operation carried out in a case where it is determined that a variation in distribution of pixels values of the respective pixels of a display screen is considerable and (ii) an example operation carried out in a case where it is determined that the variation is small or no variation is seen. (d) of FIG. 5 illustrates (i) an example operation carried out in a case where it is determined that the update image is a still image and (ii) an example operation carried out in a case where it is determined that the update image is a moving image.

Next, another example of the operation of the liquid crystal display device 1 in accordance with Embodiment 2 of the present invention will be described below with reference to FIGS. 4 and 5. FIG. 4 is a flowchart for explaining the operation of the liquid crystal display device 1. FIG. 5 is a timing chart for explaining the operation of the liquid crystal display device 1.

In S7 illustrated in FIG. 4, the image analyzing section 32 determines, with use of the timer 35 as described above, whether image data of an update image which image data is supplied to the DBC circuit 3 indicates a moving image or a still image (the operation proceeds to S8). How to make such a determination is as described above.

In S8, in a case where the image analyzing section 32 determines that the image data of the update image indicates a still image, the operation proceeds to S9. In a case where the image analyzing section 32 determines that the image data of the update image indicates a moving image, the operation proceeds to S13.

In S10, the image analyzing section 32 determines whether an index, indicative of a variation between (i) distribution of pixel values of the display panel 42 which displays an image coming prior to the update image and (ii) the distribution of the pixel values of the display panel 42 which displays the update image, is greater than a threshold. How to make such a determination is as described above.

In a case where, as a result of the determination, the image analyzing section 32 determines that the variation in distribution of the pixel values is considerable (the index indicative of the variation in distribution of the pixel values of the panel 42 is greater than the threshold), the operation proceeds to S11. In a case where the variation in distribution of the pixel values is small or no variation is seen (the index indicative of the variation in distribution of the pixel values of the panel 42 is equal to or lower than the threshold or the index does not show any variation), the operation proceeds to S12.

In S11, the DBC is carried out in accordance with the update image and an additional frame image. Specifically, the display driving control section 331 transmits an "image output request (request signal, another request signal) to the CPU 22 at an appropriate timing so as to output the image data of the update image or image data of the additional frame image to the display panel 42 in accordance with (i) the predetermined number of stages the DBC is carried out, (ii) a predetermined amount of each raise of the pixel values in each of the stages, and (iii) a predetermined interval between output of the update image and output of a single additional frame image or between output of two or more additional frame images.

The number of the stages the DBC is carried out only needs to be at least one, and is set such that no flicker is caused in a display and an effect of reducing electric power consumption of the oxide semiconductor liquid crystal panel is not greatly lowered. Meanwhile, the amount of the each raise of the pixel values in each of the stages only needs to be predetermined in accordance with (i) the number of the stages the DBC is carried out, (ii) initial gradations of the display screen, (iii) target gradations of the display screen, and the like. The interval between the output of the update image and the output of the additional frame image only needs to be set as appropriate within a range of 1 (one) second. The interval is set such that no flicker is caused in a display and the effect of reducing the electric power consumption of the oxide semiconductor liquid crystal panel is not greatly lowered.

In each of the stages the DBC is carried out, the pixel value adjusting section 3312 increases the pixels values of the respective pixels of the display panel 42 which is to display an image, by the predetermined amount from those before the foregoing determination. In a case where the pixel value adjusting section 3312 increases the pixel values of the respective pixels of the display panel 42 from those before the foregoing determination, the pixel value adjusting section 3312 notifies the BL control section 34 of pixel value change information on such control. In this case, the BL control section 34 lowers the brightness of the backlight 41 from that before the foregoing determination, in accordance with a change in pixel values of the respective pixels made by the pixel value adjusting section 3312.

(c) of FIG. 5 illustrates how additional frame images for use in the DBC are outputted while such refresh driving as illustrated in (b) of FIG. 5 is being carried out. For example, according to an example illustrated in (c) of FIG. 5, in a case where the variation in distribution of the pixel values of the respective pixels of the display panel 42 is considerable, three additional frame images "α" are outputted after the update image "A" is outputted, and three additional frame images "β" are outputted after the update image "B" is outputted. After the update image "C" is outputted, two additional frame images "γ" are outputted.

Note that, as illustrated in (c) of FIG. 5, in a case where the additional frame image is outputted, the DBC can be carried out in stages with respect to both the update image and the additional frame image or can be alternatively carried out in stages with respect to merely the additional frame image without being carried out with respect to the update image. According to an example illustrated in (d) of FIG. 5, in a case where the variation in distribution of the pixel values is considerable, two additional frame images "α" are outputted after the update image "A" is outputted. As such, the number of the additional frame images is reduced from three in (c) of FIG. 5 to two in (d) of FIG. 5. That is, according to (d) of FIG. 5, output of the additional frame images "α" is arranged so as to finish earlier than that in (c) of FIG. 5. According to the example illustrated in (d) of FIG. 5, since the number of the additional frame images "α" is smaller, it is possible to suppress occurrence of an unnecessary additional frame as compared with the example illustrated in (c) of FIG. 5.

In S12, the DBC is not carried out or the DBC is carried out in accordance with the low refresh driving. More specifically, in a case where the image analyzing section 32 determines that the variation in distribution of the pixel values is small or no variation is seen, the display driving control section 331 stops transmitting the "image output request (request signal, another request signal), which requests output of the additional frame image for use in the DBC, in response to a result of such a determination. In this case, as illustrated in (c) of FIG. 5, no additional frame image is outputted. Alternatively, the display driving control section 331 can carry out the DBC with respect to both the update image "B" and additional refresh image "B" or with respect to any one of the update image "B" and the additional refresh image "B," as illustrated in (d) of FIG. 5.

Next, in S13, in a case where the image analyzing section 32 determines that the update image is a moving image, the display driving control section 331 carries out the DBC in accordance with output of the image data of the update image, as with the case where the image analyzing section 32 determines that the update image is a moving image in the example illustrated in (d) of FIG. 5.

[Embodiment 3; software implementation example]

A control block (especially, the image analyzing section 32, the image processing section 33, the BL control section 34, and the display driving control section 331) of the DBC circuit 3 can be realized by a logic circuit (hardware) provided in an integrated circuit (IC chip) or the like or can be alternatively realized by software as executed by a CPU (Central Processing Unit).

In the latter case, the DBC circuit 3 includes: a CPU that executes instructions of a program (dynamic backlight control program) which is software realizing the foregoing functions; a ROM (Read Only Memory) or a storage device (each referred to as a "storage medium") in each of which the program and various kinds of data are stored in such a form that they are readable by a computer (or CPU); and a RAM (Random Access Memory) which develops the program in executable form. The object of the present invention can be attained by a computer (or a CPU) reading and executing the program stored in the storage medium. The storage medium may be "a non-transitory tangible medium" such as a tape, a disk, a card, a semiconductor memory, and a programmable logic circuit. Further, the program may be made available to the computer via any transmission medium (such as a communication network and a broadcast wave) which enables transmission of the program. Note that the present invention can also be implemented by the program in the form of a computer data signal embedded in a carrier wave which is embodied by electronic transmission.

[Summary]

A control device in accordance with a first aspect of the present invention is a control device (DBC circuit 3) which controls a display device (liquid crystal display device 1) capable of being driven at a low refresh rate, including: an image analyzing section (32) which determines whether a first image, to which a second image displayed by a display screen is updated in response to a request to update the second image, is a still image or a moving image; an image processing section (33) which, in a case where the image analyzing section (32) determines that the first image is the moving image, increases pixel values of respective pixels of the display screen which is to display the first image, from those before the image analyzing section (32) determines that the first image is the moving image; and a backlight control section (BL control section 34) which lowers, in accordance with an increase in pixel values of the respective pixels, brightness of a backlight from that before the image analyzing section (32) determines that the first image is the moving image.

According to the above configuration, it is determined whether an update image to which an image displayed by a display screen is updated in response to an update request is a still image or a moving image. In a case where the update image is a moving image, DBC is carried out. The DBC is as described above. In general, in a case where a moving image is reproduced, images are regularly updated in response to update requests. Therefore, by using such a plurality of update images regularly updated, it is possible to carry out the DBC in stages. Furthermore, by carrying out the DBC in stages in accordance with a plurality of update images regularly generated, it is possible to suppress generation of an unnecessary additional frame image for use in the DBC. Accordingly, it is possible to suppress a deterioration in effect of reducing electric power consumption which deterioration is caused in a case where the DBC is enabled with respect to a display device capable of being driven at a low refresh rate.

In a second aspect of the present invention, the control device can be arranged such that, in the first aspect, the image analyzing section determines whether or not an index, indicative of a variation between (i) distribution of the pixel values of the display screen which displays the second image and (ii) the distribution of the pixel values of the display screen which displays the first image, is greater than a threshold; in a case where the index is greater than the threshold, the image processing section increases, from those before the image analyzing section determines that the index is greater than the threshold, the pixel values of the respective pixels of the display screen which displays the first image; and in a case where the index is greater than the threshold, the backlight control section lowers, in accordance with the increase in pixel values of the respective pixels, the brightness of the backlight from those before the image analyzing section determines that the index is greater than the threshold.

According to the above configuration, the image analyzing section determines whether the index, indicative of the variation between (i) the distribution of the pixel values of the display screen which displays the image that comes before the update image and (ii) the distribution of the pixel values of the display screen which displays the update image, greater than the threshold. In a case where the index is greater than the threshold, the DBC is carried out. As a case where the index indicative of the variation in distribution of the pixel values is greater than the threshold, considered are (i) a case where the update image is a moving image and (ii) a case where the update image is a still image but the variation in distribution of the pixel values is considerable. On the other hand, in a case where a still image is displayed, regular image update is not expected, unlike a case where a moving image is displayed. Therefore, additional frame images for use in the DBC are preferably generated as much as possible. However, an increase in number of the additional frame images leads to a deterioration in effect of reducing electric power consumption of a display device capable of being driven at a low refresh rate. Accordingly, it is necessary to suppress generation of the additional frame images for use in the DBC as much as possible. In view of this, according to the above configuration, assuming that the update image is a still image, the DBC is carried out merely in a case where the index, indicative of the variation in distribution of the pixel values, is greater than the threshold. This makes it unnecessary to output an additional frame image, in a case where the index, in indicative of the variation in distribution of the pixel values, is equal to or lower than the threshold. It is therefore possible to suppress a deterioration in effect of reducing electric power consumption which deterioration is caused in a case where the DBC is enabled with respect to the display device capable of being driven at a low refresh rate.

Further, in a third aspect of the present invention, the control device can be arranged so as to, in the first or second aspect, further include a signal output control section (display driving control section 331) and is arranged such that, in the first or second aspect, the image analyzing section determines whether or not an index, indicative of a variation between (i) distribution of the pixel values of the display screen which displays the second image and (ii) the distribution of the pixel values of the display screen which displays the first image, is greater than a threshold; in a case where the index is greater than the threshold, the signal output control section outputs a request signal which causes at least one additional frame image to be read out from a recording section and outputted after the first image is outputted, the at least one additional frame image being identical to the first image: and in a case where the index is greater than the threshold, the image processing section increases, from those before the image analyzing section determines that the index is greater than the threshold, the pixel values of the respective pixels of the display screen which is to display the at least one additional frame image. According to the above configuration, assuming that the update image is a still image, the additional frame image (for use in the DBC) is outputted merely in a case where the index, indicative of the variation in distribution of the pixel values, is greater than the threshold. This causes output of an unnecessary additional frame image to be suppressed. It is therefore possible to suppress a deterioration in effect of reducing electric power consumption which deterioration is caused in a case where the DBC is enabled with respect to a display device capable of being driven at a low refresh rate.

Further, in a fourth aspect of the present invention, the control device can be arranged such that, in the third aspect, in a case where the index is equal to or lower than the threshold, the signal output control section stops outputting the request signal. According to the above configuration, assuming that the update image is a still image, no additional frame image (for use on the DBC) is outputted in a case where the index, indicative of the variation in distribution of the pixel values, is equal to or lower than the threshold. This causes output of the additional frame image to be suppressed. It is therefore possible to suppress a deterioration of an effect of reducing electric power consumption which deterioration is caused in a case where the DBC is enabled with respect to a display device capable of being driven at a low refresh rate.

Further, in a fifth aspect of the present invention, the control device can be arranged such that, in the third or fourth aspect, the signal output control section outputs another request signal which causes an additional refresh image to be outputted, the additional refresh image being one in which polarities of voltages, to be applied to respective electrodes of the pixels of the display screen that displays the first image to which the second image is updated in response to the request to update the second image, are inversed; and in a case where the index is equal to or lower than the threshold, the image processing section increases the pixel values of the respective pixels of the display screen which is to display the additional refresh image. As a case where the index, indicative of the variation in distribution of the pixel values, is equal to or lower than the threshold, considered is a case where (i) the update image is a still image and (ii) the variation in distribution of the pixel values is small or no variation in distribution of the pixel values is seen. In view of this, according to the above configuration, the DBC is carried out with use of the additional refresh image. That is, by carrying out the DBC with use of the update image as well as the additional refresh image, it is possible to carry out the DBC in stages. This causes generation of the additional frame image for use in the DBC to be suppressed. It is therefore possible to suppress generation of an unnecessary frame image corresponding to the additional frame image. It is thus possible to suppress a deterioration in effect of reducing electric power consumption which deterioration is caused in a case where the DBC is enabled with respect to a display device capable of driven at a low refresh rate.

Further, the control device in accordance with the first through fifth aspect of the present invention can be realized by a computer, and the scope of the present invention encompasses (i) a dynamic backlight control program which causes a computer to carry out processes (A) through (C) carried out by a control device recited in any one of the first through fifth aspect, the process (A) being a process of determining whether a first image, to which a second image displayed by a display screen is updated in response to a request to update the second image, is a still image or a moving image; the process (B) being a process of, in a case where it is determined that the first image is the moving image, increasing pixel values of respective pixels of the display screen which is to display the first image, from those before it is determined that the first image is the moving image; the process (C) being a process of lowering, in accordance with an increase in pixel values of the respective pixels of the display screen which is to display the first image, brightness of a backlight from that before it is determined that the first image is the moving image. The scope of the present invention also encompasses a recording medium in which the dynamic backlight control program is computer-readably recorded.

The present invention is not limited to the embodiments, but can be altered by a skilled person in the art within the scope of the claims. An embodiment derived from a proper combination of technical means each disclosed in a different embodiment is also encompassed in the technical scope of the present invention. Further, it is possible to form a new technical feature by combining the technical means disclosed in the respective embodiments.

INDUSTRIAL APPLICABILITY

The present invention is applicable to a display device and a control device for controlling the display device. For example, the present invention is suitable for a liquid crystal display device, a host control section of a liquid crystal display device, a liquid crystal driver, a liquid crystal driver controller (LCDC), and the like.

REFERENCE SIGNS LIST

3 DBC circuit (control device)
4 Display section (display device)
23 Temporary recording section (VRAM: recording section)
32 Image analyzing section
33 Image processing section
34 BL control section (backlight control section)
41 Backlight
331 Display driving control section (signal output control section)

The invention claimed is:

1. A control circuit which controls a display device capable of being driven at a low refresh rate, comprising:

an image analyzing section which determines whether a first image, to which a second image displayed by a display screen is updated in response to a request to update the second image, is a still image or a moving image;

an image processing section which, in a case where the image analyzing section determines that the first image is the moving image, increases gradation values of respective pixels of the display screen which is to display the first image, from those before the image analyzing section determines that the first image is the moving image;

a backlight control section which lowers, in accordance with an increase in gradation values of the respective pixels, brightness of a backlight from that before the image analyzing section determines that the first image is the moving image; and a signal output control section, wherein the image analyzing section determines whether or not an index, indicative of a variation between (i) distribution of the gradation values of the display screen which displays the second image and (ii) the distribution of the gradation values of the display screen which displays the first image, is greater than a threshold, in a case where the index is greater than the threshold, the signal output control section outputs a request signal which causes at least one additional frame image to be read out from a recording section and outputted after the first image is outputted, the at least one additional frame image being identical to the first image, in a case where the index is greater than the threshold, the image processing section increases, from those before the image analyzing section determines that the index is greater than the threshold, the gradation values of the respective pixels of the display screen which is to display the at least one additional frame image, and the at least one additional frame image is image data used in dynamic backlight control.

2. The control circuit as set forth in claim 1, wherein:

in a case where the index is greater than the threshold, the image processing section increases, from those before the image analyzing section determines that the index is greater than the threshold, the gradation values of the respective pixels of the display screen which displays the first image; and in a case where the index is greater than the threshold, the backlight control section lowers, in accordance with the increase in gradation values of the respective pixels, the brightness of the backlight from those before the image analyzing section determines that the index is greater than the threshold.

3. A control circuit which controls a display device capable of being driven at a low refresh rate, comprising:

an image analyzing section which determines whether a first image, to which a second image displayed by a display screen is updated in response to a request to update the second image, is a still image or a moving image;

an image processing section which, in a case where the image analyzing section determines that the first image is the moving image, increases gradation values of respective pixels of the display screen which is to display the first image, from those before the image analyzing section determines that the first image is the moving image;

a backlight control section which lowers, in accordance with an increase in gradation values of the respective pixels, brightness of a backlight from that before the image analyzing section determines that the first image is the moving image; and a signal output control section, wherein the image analyzing section determines whether or not an index, indicative of a variation between (i) distribution of the gradation values of the display screen which displays the second image and (ii) the distribution of the gradation values of the display screen which displays the first image, is greater than a threshold, in a case where the index is greater than the threshold, the signal output control section outputs a request signal which causes at least one additional frame image to be read out from a recording section and outputted after the first image is outputted, the at least one additional frame image being identical to the first image, in a case where the index is greater than the threshold, the image processing section increases, from those before the image analyzing section determines that the index is greater than the threshold, the gradation values of the respective pixels of the display screen which is to display the at least one additional frame image, and in a case where the index is equal to or lower than the threshold, the signal output control section stops outputting the request signal.

4. The control circuit as set forth in claim 1, wherein:

the signal output control section outputs another request signal which causes an additional refresh image to be outputted, the additional refresh image being one in which polarities of voltages, to be applied to respective electrodes of the pixels of the display screen that displays the first image to which the second image is updated in response to the request to update the second image, are inversed; and in a case where the index is equal to or lower than the threshold, the image processing section increases the gradation values of the respective pixels of the display screen which is to display the additional refresh image.

5. A method of controlling a control circuit which controls a display device capable of being driven at a low refresh rate; the method comprising the steps of:

(a) determining whether a first image, to which a second image displayed by a display screen is updated in response to a request to update the second image, is a still image or a moving image;

(b) increasing, in a case where it is determined that the first image is the moving image, gradation values of respective pixels of the display screen which is to display the first image, from those before it is determined that the first image is the moving image;

(c) lowering, in accordance with an increase in gradation values of the respective pixels of the display screen which is to display the first image, brightness of a backlight from that before it is determined that the first image is the moving image;

(d) determining whether or not an index, indicative of a variation between (i) distribution of the gradation values of the display screen which displays the second image and (ii) the distribution of the gradation values of the display screen which displays the first image, is greater than a threshold, in a case where the index is greater than the threshold, outputting a request signal which causes at least one additional frame image to be read out from a recording section and outputted after the first image is outputted, the at least one additional frame image being identical to the first image, and in a case where the index is greater than the threshold, increasing, from those before the image analyzing section determines that the index is greater than the threshold, the gradation values of the respective pixels of the display screen which is to display the at least one additional frame image, wherein the at least one additional frame image is image data used in dynamic backlight control.

6. The control circuit as set forth in claim 3, wherein:

the signal output control section outputs another request signal which causes an additional refresh image to be outputted, the additional refresh image being one in which polarities of voltages, to be applied to respective electrodes of the pixels of the display screen that displays the first image to which the second image is updated in response to the request to update the second image, are inversed; and in a case where the index is equal to or lower than the threshold, the image processing section increases the gradation values of the respective pixels of the display screen which is to display the additional refresh image.

* * * * *